United States Patent [19]

Lucciola

[11] 4,227,273

[45] Oct. 14, 1980

[54] AQUATIC SWIMMING AID

[76] Inventor: Benjamin A. Lucciola, R.R. 1, Box 3056 Sunrise Lake, Milford, Pa. 18337

[21] Appl. No.: 900,266

[22] Filed: Apr. 26, 1978

[51] Int. Cl.[3] ..... A63B 31/02

[52] U.S. Cl. ..... 9/307; 9/310 J; 35/29 B

[58] Field of Search ..... 272/1 B; 35/29 B; 9/11 R, 14, 301, 307, 310 R, 310 J; 114/221 R

[56] References Cited

U.S. PATENT DOCUMENTS

| | | | |
|---|---|---|---|
| 1,099,575 | 6/1914 | Skaszynski | 9/310 J |
| 1,349,891 | 8/1920 | Kuzneizoff | 272/1 B |
| 2,109,429 | 2/1938 | Malm | 9/307 |
| 2,477,410 | 7/1949 | Johnson | 114/221 R |
| 2,709,266 | 5/1955 | Munn | 35/29 B |
| 2,859,458 | 11/1958 | Calarco | 9/11 R |
| 3,802,366 | 4/1974 | Mankawich | 114/61 X |
| 3,998,175 | 12/1976 | Pless | 114/61 X |
| 4,061,099 | 12/1977 | Cook | 114/61 X |

FOREIGN PATENT DOCUMENTS

| | | | |
|---|---|---|---|
| 757954 | 5/1967 | Canada | 9/307 |
| 1036729 | 8/1958 | Fed. Rep. of Germany | 9/307 |

*Primary Examiner*—George E. A. Halvosa
*Attorney, Agent, or Firm*—Charles E. Pfund

[57] ABSTRACT

An aquatic swimming aid comprising spaced-apart floats and an elongate rigid structure fixed at its ends to said floats so as to hold the floats rigidly spaced apart, the elongate structure being sufficiently long to permit several swimmers to be supported thereby side-by-side. There are longitudinally-spaced openings along the one side of the structure which may be grasped by a swimmer and at least one handhold opening at the other side which may be grasped by a swimming instructor.

2 Claims, 6 Drawing Figures

AQUATIC SWIMMING AID

BACKGROUND OF INVENTION

Elongate life-preserving floats, kickboards with floats adapted to support a number of persons, kickboards with floats for a single person and the like are shown, for example, in U.S. Pat. Nos. 2,859,458 and Lindgrem 2,593,321. However, so far as is known, there are no structures designed specifically to enable an instructor to conduct instructions in the water with a group of students and in such a fashion as to enable the instructor to demonstrate to a degree the importance of kicking in the art of swimming. The device of this invention is specifically for the aforesaid purposes. However, it has the further advantages that it will serve as a life-saver in the event that a swimmer becomes panicked and has to have support, and when pushed and pulled about in the water in sport, means for improving the strength, endurance and confidence of both beginners and competent swimmers.

SUMMARY OF INVENTION

As herein illustrated, the aquatic swimming device comprises a pair of spaced-apart floats and an elongate structure fixed at its ends to the floats so as to hold the floats rigidly spaced apart. The elongate structure is sufficiently rigid to withstand stresses without appreciable bending, is sufficiently long to permit a group of swimmers to receive support therefrom side-by-side and is of a configuration which can be readily hand-grasped. The floats are comprised of a material which will float in the water with approximately the upper halves above water and the ends of the structure are fixed in the floats so as to be substantially at the level of the water. The floats are comprised of styrofoam and may be of rectangular or circular section. In one form, the rigid structure is a plank secured at its ends in the floats which has along one edge a plurality of spaced openings comprising handholds and along the other edge at least one handhold. In another form, the rigid structure comprises spaced, parallel pipes, the ends of which are fixed in the floats and a brace holding the pipes in spaced relation. The pipes are of a size to enable readily grasping them.

The invention will now be described in greater detail with reference to the accompanying drawings, wherein.

Figure 1:
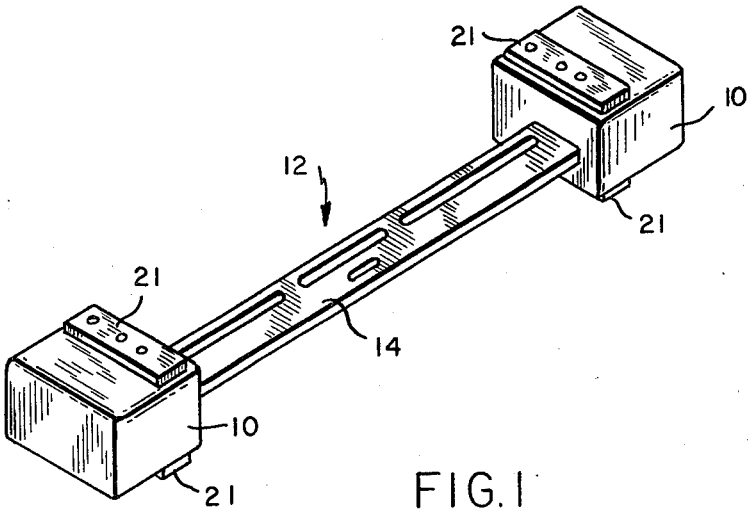
FIG. 1 is a perspective view of one form of the aquatic swimming aid of this invention.
Figure 2:
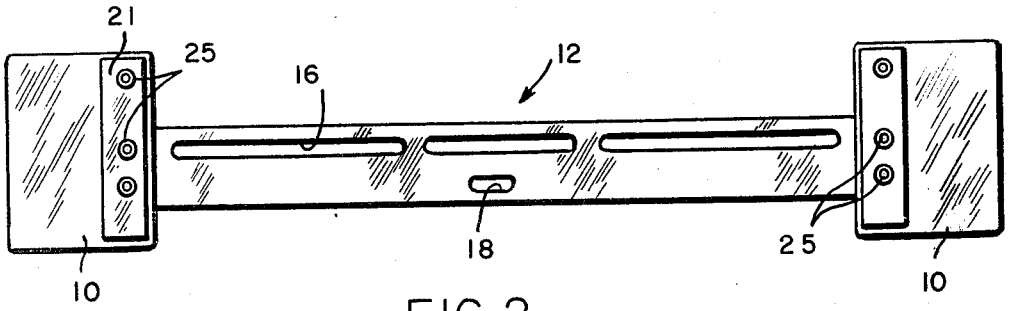
FIG. 2 is a plan view.
Figure 3:
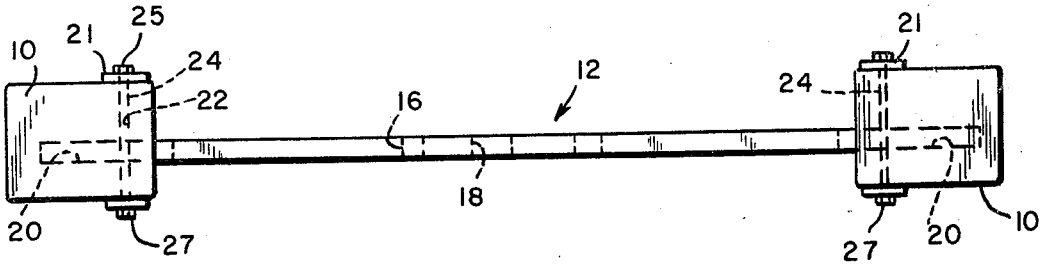
FIG. 3 is an elevation.

Referring to the drawings, FIGS. 1 to 3, the aquatic swimming aid comprises spaced-apart floats 10—10 and an elongate rigid structure 12 fixed at its ends to the floats so as to hold the floats spaced apart a sufficient distance to enable a number of swimmers, by placing their hands on the rigid structure, to receive sufficient support to hold them afloat without effort, while receiving instructions from a swimming instructor also in the water. To enable the swimmers to easily grasp and hold onto the structure, one edge of the elongate structure which comprises, as shown in FIG. 1, a wood plank 14, has longitudinally-spaced handhold openings 16. At the other edge, there is a handhold opening 18 which the instructor may grasp either to support himself relatively stationary while giving instructions or to enable maneuvering the device by pushing or pulling it to cause student swimmers to respond to instructions given by the instructor.

The floats 10—10 in this form of the invention are comprised of styrofoam of generally rectangular, horizontal and vertical section. These blocks may be solid or may be made up of a number of pieces stacked upon each other. In any event, the inner sides of the block contain horizontal openings 20 for receiving the ends of the plank and vertical openings 22 for receiving bolts 24 for attaching the ends of the plank to the blocks. Desirably, narrow strips of wood 21 are mounted beneath the heads 25 of the bolts 24 at the top sides and the nuts 27 at the bottom sides.

The floats are styrofoam blocks 20″ long, 16″ wide and 13″ deep. The rigid structure is a yellow pine plank 8′6″ long, 8″ wide and 2″ thick. The strips 20 are, respectively, 1″×6″×19″ at the top side and 1″×4″×19″ at the bottom side. The dimensions given are merely suggestive and may be varied to suit any particular purpose without departing from the intent and purposes of this invention. The entire structure may be painted or varnished to improve its resistance to becoming water-soaked and, desirably, is painted a bright color so as to be easily located by a swimmer at water level.

Figure 4:
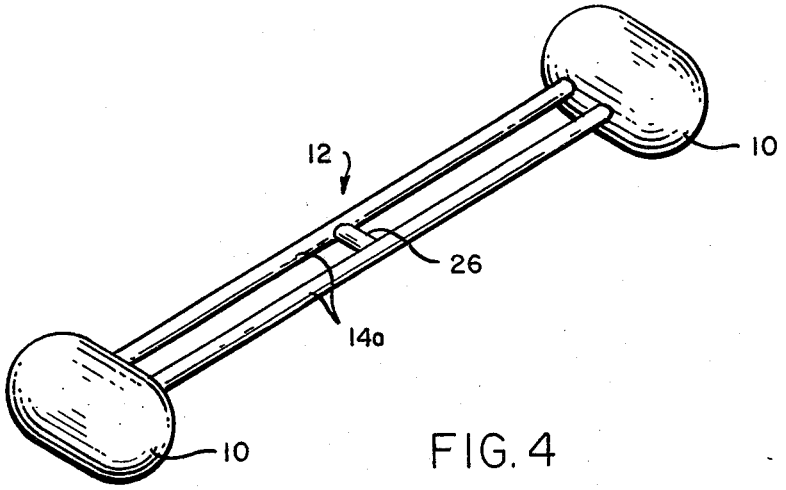
FIG. 4 is a perspective view of an alternative form.
Figure 5:
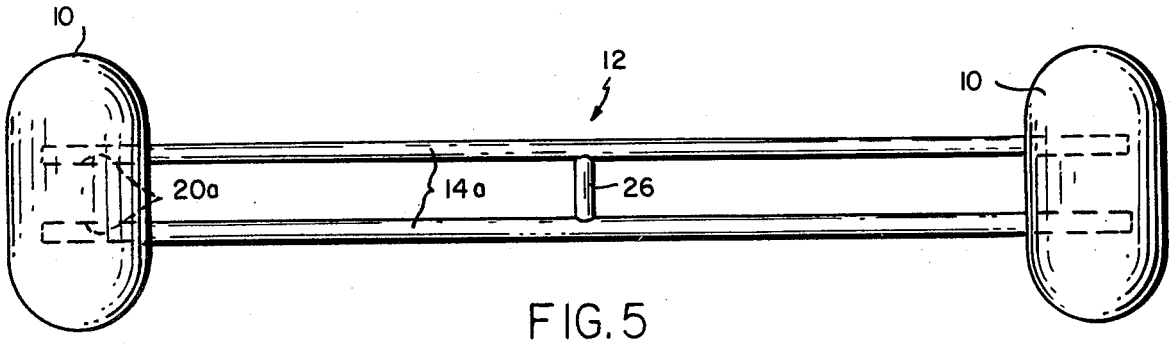
FIG. 5 is a plan view of the alternative form of the invention.
Figure 6:
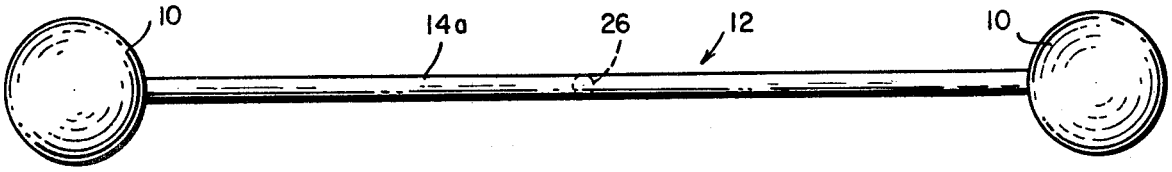
FIG. 6 is an elevation thereof.

Alternatively, as shown in FIGS. 4, 5 and 6, the floats 10—10 are torpedo-shaped blocks of circular cross section and the elongate rigid structure 12 connecting the floats in spaced apart relation are a pair of spaced, parallel, rigid pipes **14*a*—14*a* of heavy-duty plastic. The opposite ends of the pipes are fixed in horizontal holes 20*a* formed in the floats. The floats are styrofoam and the ends of the pipes are glued or cemented into the openings 20*a*—20*a*. Midway between the opposite ends of the pipes, there is a reinforcing brace 26 secured at its ends by welding or cementing to the pipes 14*a*—14*a*. The pipes 14*a*—14*a*** are 10′ long and approximately 1½″–2″ in diameter so as to be easily grasped and yet are sufficiently rigid to withstand bending or twisting when a number of swimmers place their hands upon the structure for support. The torpedo-shaped styrofoam blocks are approximately 30″ long and 16″ in diameter.

As previously suggested, the structure in either form is particularly adapted to be used for the instruction of beginners to enable beginners to hold their position afloat in the water while receiving instructions from the instructor, and to enable timid and unskilled swimmers to gain confidence and strength in competition with more experienced swimmers by pushing and pulling the device about in the water.

It should be understood that the present disclosure is for the purpose of illustration only and includes all modifications or improvements which fall within the scope of the appended claims.

I claim:

1. An aquatic swimming aid comprising spaced-apart floats, a rigid, elongate support structure and means connecting the ends of the support structure to the floats, said rigid, elongate support structure comprising a relatively long, flat wooden board wider than thick, said board having along one edge longitudinally-spaced slots, three in number, arranged symmetrically, two long slots and intermediate the long slots a short slot and at the other edge a slot shorter than the intermediate slot at the one edge, said slots being parallel to their respective edges, said means attaching the ends of the support structure to the floats comprising in combination openings in the confronting faces of the floats for snugly receiving the ends of the board partway but not all the way through, spaced through holes perpendicular to the openings, at least two of such holes passing through the openings, said board having in the end portions occupying the openings pairs of holes corresponding in spacing to said through holes, reinforcing members at the top and bottom sides of the floats overlying the holes, said reinforcing members containing holes corresponding in spacing to the through holes in the floats and bolts headed at one end and provided with nuts at their other ends extending through the reinforcing members, ends of the board and floats, securing the ends of the board to the floats.

2. An aquatic device according to claim 1 wherein the floats are blocks of styrofoam.

* * * * *